US005158203A

United States Patent [19]

Coffin

[11] Patent Number: 5,158,203

[45] Date of Patent: Oct. 27, 1992

[54] SEGMENTED COMPOSITE CYLINDER ASSEMBLY

[75] Inventor: Paul Coffin, Chesapeake Beach, Md.

[73] Assignee: The United States of America as represented by the Secretary of the Navy, Washington, D.C.

[21] Appl. No.: 838,985

[22] Filed: Feb. 21, 1992

[51] Int. Cl.[5] ..... B65D 43/03; B65D 55/00

[52] U.S. Cl. ..... 220/680; 220/660; 206/519; 206/520

[58] Field of Search ..... 123/193.4, 193.2; 220/660, 680, 380; 206/519, 520; 138/155, 172, 120

[56] References Cited

U.S. PATENT DOCUMENTS

| | | | |
|---|---|---|---|
| 2,323,316 | 7/1943 | Dieter | 220/680 |
| 4,231,476 | 11/1980 | Compton et al. | 206/520 |
| 4,407,426 | 10/1983 | McLaren et al. | 220/380 |
| 4,415,387 | 11/1983 | Newman | 220/680 |
| 4,828,112 | 5/1989 | Vollrath et al. | 206/519 |

FOREIGN PATENT DOCUMENTS

| | | | |
|---|---|---|---|
| 0865024 | 4/1961 | United Kingdom | 220/660 |

OTHER PUBLICATIONS

Lee, Soo-Young and G. S. Springer, "Filament Winding Composite Cylinders: II, Thick Cylinders," Stanford University Department of Aeronautics and Astronautics, Stanford, CA Aug. 1989 pp. 107 and 109.

Welch, D. E., H. W. Blake, and R. E. Garvey, "Compression Tests of Thick Composite Rings," 4th Annual Thick Composite in Compression Workship, Jun. 26, 1990, pp. 486-487.

Frame, B. J., "Failure Analysis of ETAC Pressure Vessel," prepared by Oak Ridge Gaseous Diffusion Plant for U.S. Dept. of Energy under Contract DE-AC0-5-840R21400, Jun. 1987, pp. 13-15.

Rasmussen, E. A. and J. R. Carlberg, "Shock Response of Ring Stiffened Glass/Epoxy," DTRC-SSPD-91-17-2-75, Bethesda, Apr. 1991, pp. 1, 7, 43, 46.

Harruff, P. W., Frank C. Spicola and T. Tsuchiyama, "Filament Wound Torpedo Hull Structures," Soc. of Manuf. Eng., 1986, Dearborn , pp. 12-16, 18 (no month provided).

*Primary Examiner*—E. Rollins Cross
*Assistant Examiner*—M. Macy
*Attorney, Agent, or Firm*—Howard Kaiser; Charles D. Miller

[57] ABSTRACT

A circumferential rib-stiffened hollow cylinder and method for fabrication thereof featuring construction of the cylinder from complementarily shaped nestled prefabricated rings and resultant circumferential ribs which are integral with the rest of the cylinder. In one embodiment ring sections which are "L"-shaped in cross-section are axially and sequentially mated; ring sections which are "U"-shaped are axially and correspondingly integrated therewith, therein for a cylinder having internal circumferential ribs and thereout for a cylinder having external circumferential ribs. The dominant load path for the cylinder is through the reinforced cylinder elements, and the cylinder's wall-thickness-to-diameter ratio is effectively reduced, thereby allowing radial reinforcement of the ribs, reducing residual stresses and increasing strength; these advantages are especially significant for cylinders which are composite or are to be subjected to hydrostatic pressure. Moreover, in comparison with conventional cylinders of monocoque construction, manufacture and quality control may be expected to be more economical and cost-effective.

26 Claims, 7 Drawing Sheets

SEGMENTED COMPOSITE CYLINDER ASSEMBLY

The invention described herein may be manufactured and used by or for the Government of the United States of America for governmental purposes without the payment of any royalties thereon or therefor.

BACKGROUND OF THE INVENTION

The present invention relates to cylinder fabrication methods, more particularly to methods for fabricating composite cylinders which are suitably used as underwater pressure hulls.

Conventional techniques for fabrication of thick section composite cylinders, i.e., cylinders with relatively high cylinder wall-thickness-to-diameter ratios, have been fraught with problems pertaining to residual stresses. Thick section composite cylinder residual stresses typically load the hoop or circumferential fibers in compression on the outside diameter and tension on the inside diameter. See Lee, Soo-Yong, and G. S. Springer, "Filament Winding Composite Cylinders: II. Thick Cylinders," Stanford University, Department of Aeronautics and Astronautics, Stanford, California, August 1989, incorporated herein by reference, esp. pages 107 and 109. This weakens the cylinder when loaded by external pressure or internal pressure (where the cylinder's strength is based on material properties and not on structural stability) because of this initial compressive stress or tensile stress, respectively. Hence, reducing the residual stresses can help to increase the cylinder's strength.

Strains as high as 20% of the ultimate strains caused by residual stresses have been measured on thick section rings. See Welch, D. E., H. W. Blake, and R. E. Garvey, "Compression Tests of Thick-Composite Rings," *Fourth Annual Thick Composites in Compression Workshop*, Jun. 26, 1990, incorporated herein by reference, esp. pages 486–487. It has been reported that an eight inch diameter thick section cylinder delaminated while in storage, most likely due to residual stresses. See Frame, B. J., "Failure Analysis of ETAC Pressure Vessel," prepared by the Oak Ridge Gaseous Diffusion Plant for the U.S. Department of Energy under Contract DE-ACO5-840R21400, June 1987, incorporated herein by reference, esp. pages 13–15; in this reported case. the residual stresses apparently developed strains of 100% of the ultimate in the cylinder wall.

There is not an abundance of published information on composite pressure hull fabrication techniques, as only a limited number of scale hull cylinders have been built. Many of these were filment wound monolithic sections. See Stachiw, J. D., and B. Frame, "Graphite-Fiber-Reinforced Plastic Pressure Hull Mod 2 for the Advanced Unmanned Search System Vehicle,"Technical Report 1245, Naval Ocean Systems Center, San Diego, August 1988, incorporated herein by reference, esp. pages 16–20, 41, 44 and 83. Some of these monolithic cylinders had ring stiffeners machined into the inner diameter. See Rasmussen, E. A., and J. R. Carlberg, "Shock Response of Ring Stiffened Glass-/Epoxy," David Taylor Research Center, U.S. Navy, DTRC-SSPD-91-172-75, Bethesda, Maryland, April 1991, incorporated herein by reference, esp. pages 1, 7, 43 and 46. Other cylinders had ring stiffeners bonded to the inner diameter. See Harruff, P. W., Frank C. Spicola, and T. Tsuchiyama, "Filament Wound Torpedo Hull Structures," Society of Manufacturing Engineers, 1986, Dearborn, Michigan, incorporated herein by reference, esp. pages 12–16 and 18.

The U.S. Navy has devoted considerable effort toward development of composite underwater pressure hulls for its submarines and other submersible vehicle structures. Small scale hulls have typically been thick-walled filament-wound cylinders with, if required, circumferential ribs machined out from the inside.

Utilization of a similar fabrication process for large scale hulls would be expensive; it would require a large investment in capital equipment, advances in thick section composite quality control and advances in state of the art "non destructive examination" (NDE).

Although other proposed fabrication methods can reduce fabrication equipment requirements, they still produce a monocoque hull, thus posing the same NDE difficulties. Few, if any, of the fabrication processes developed and proposed for circumferentially stiffened pressure hulls allow the integral fabrication of the stiffeners, have the stiffeners as an integral part of the hull, or provide for radial reinforcement of the stiffeners.

OBJECTS OF THE INVENTION

In view of the foregoing, it is an object of the present invention to provide a composite cylinder, especially one which is suitably used as an underwater pressure hull, along with a fabrication process therefor, which is more economical and cost-effective.

It a further object of the present invention to provide such a cylinder and fabrication process which integrates the cylinder with circumferential rib-stiffeners.

Another object of this invention is to provide such a cylinder and fabrication process wherein the cylinder admits of radial reinforcement of the circumferential rib-stiffeners.

A further object of this invention is to provide such a cylinder and fabrication process wherein the cylinder has reduced residual stresses and therefore increased strength.

SUMMARY OF THE INVENTION

The present invention provides an internally circumferentially rib-stiffened hollow cylinder, comprising: a plurality of axially and sequentially mated L-rings; and, a plurality of U-rings axially and correspondingly integrated within said L-rings.

This invention also provides a method for fabricating an internally circumferentially rib-stiffened hollow cylinder, comprising: axially and sequentially mating a plurality of L-rings; and, axially and correspondingly integrating within said L-rings a plurality of U-rings.

In accordance with this invention, as pertains to internally as distinguished from externally rib-stiffened cylinders, each L-ring has a circumferentially planar radially outer L-wall, a circumferential L-bend interface and a radially planar radially inner L-wall, defining in outwardly radial cross-section an approximate inverted "L"-shape. The circumferentially planar outer L-wall has a circumferential radially outer L-edge, a circumferentially planar radially outer interior L-surface and a circumferentially planar radially outer exterior L-surface. The radially planar inner L-wall has a circumferential radially inner L-edge, a radially planar radially inner interior L-surface and a radially planar radially inner exterior L-surface. Each L-ring other than the sequentially last L-ring is overlappingly aligned with a sequentially succeeding L-ring so as to have flush a portion of the outer interior L-surface which is bounded by the outer L-edge with a portion of the outer exterior L-surface of the sequentially succeeding L-ring which is bounded by the L-bend interface. Each U-ring has a circumferentially planar radially outer U-wall, a pair of circumferential U-bend interfaces and a pair of radially planar radially inner U-walls defining in outwardly radial cross-section an approximate inverted "U"-shape. The circumferentially planar outer U-wall has a circumferentially planar radially outer interior U-surface and a circumferentially planar radially outer exterior U-surface. Each radially planar inner wall has a circumferential radially inner U-edge, a radially planar radially inner interior U-surface and a radially planar radially inner exterior U-surface. Each U-ring other than the sequentially last U-ring is adjacently aligned with a sequentially succeeding U-ring so as to have flush: the outer exterior U-surface with a portion of one outer interior L-surface; one inner exterior U-surface with the inner interior L-surface of the same L-ring; and, the other inner exterior U-surface with the inner exterior L-surface of the sequentially succeeding L-ring. The sequentially last U-ring has flush: the outer exterior U-surface with a portion of one outer interior L-surface; and, one inner exterior U-surface with one inner interior L-surface of the same L-ring.

The present invention further provides an externally circumferentially rib-stiffened hollow cylinder, as well as a method for fabricating an externally circumferentially rib-stiffened hollow cylinder. The externally rib-stiffened cylinder in accordance with this invention comprises: a plurality of axially and sequentially mated L-rings; and, a plurality of U-rings axially and correspondingly integrated without said L-rings. The method for fabricating an externally rib-stiffened cylinder in accordance with this invention comprises: axially and sequentially mating a plurality of L-rings; and, axially and correspondingly integrating without said L-rings a plurality of U-rings.

In accordance with this invention, as pertains to externally as distinguished from internally rib-stiffened cylinders, each L-ring has a circumferentially planar radially inner L-wall, a circumferential L-bend interface and a radially planar radially outer L-wall, defining in outwardly radial cross-section an approximate "L"-shape. The circumferentially planar inner L-wall has a circumferential radially inner L-edge, a circumferentially planar radially inner interior L-surface and a circumferentially planar radially inner exterior L-surface. The radially planar outer L-wall has a circumferential radially outer L-edge, a radially planar radially outer interior L-surface and a radially planar radially outer exterior L-surface. Each L-ring other than the sequentially last L-ring is overlappingly aligned with a sequentially succeeding L-ring so as to have flush a portion of the inner interior L-surface which is bounded by the inner L-edge with a portion of the inner exterior L-surface of the sequentially succeeding L-ring which is bounded by the L-bend interface. Each U-ring has a circumferentially planar radially inner U-wall, a pair of circumferential U-bend interfaces and a pair of radially planar radially outer U-walls defining in outwardly radial cross-section an approximate "U"-shape. The circumferentially planar inner U-wall has a circumferentially planar radially inner interior U-surface and a circumferentially planar radially inner exterior U-surface. Each radially planar outer wall has a circumferential radially outer U-edge, a radially planar radially outer interior U-surface and a radially planar radially outer exterior U-surface. Each U-ring other than the sequentially last U-ring is adjacently aligned with a sequentially succeeding U-ring so as to have flush: the inner exterior U-surface with a portion of one inner interior L-surface; one outer exterior U-surface with the outer interior L-surface of the same L-ring; and, the other outer exterior U-surface with the outer exterior L-surface of the sequentially succeeding L-ring. The sequentially last U-ring has flush: the inner exterior U-surface with a portion of one inner interior L-surface; and, one outer exterior U-surface with one outer interior L-surface of the same L-ring.

Some embodiments of this invention implement a perpendicularized configuration wherein all the L-walls and U-walls are essentially straight; here, each L-ring has a circumferentially planar L-wall which is perpendicular with respect to the radially planar L-wall, and each U-ring has a circumferentially planar U-wall which is perpendicular with respect to the two radially planar U-walls. Here, some internally ribbed embodiments taper the circumferentially planar outer L-wall and some externally ribbed embodiments taper the circumferentially planar inner L-wall in furtherance of, respectively, a substantially continuous or smooth outer surface and a substantially continuous or smooth inner surface; thus, the outer interior L-surface is perpendicular to the inner interior L-surface, while for internally ribbed embodiments the outer exterior L-surface is tapered and for externally ribbed embodiments the inner exterior L-surface is tapered.

Although these embodiments of the present invention may be suitable for some applications, certain disadvantages are manifest which are overcome in other, preferred embodiments of the present invention. Notably, since succeeding L-rings are nestled within or without preceeding L-rings in accordance with this invention, size uniformity of the L-rings is not possible for these embodiments; moreover, the completed cylinders according to these embodiments have axially-longitudinally graduated circumferential cylindricality rather than uni-circumferential cylindricality.

Hence, other, preferred embodiments of this invention provide cylinders and fabrication methods therefor which admit of uniformity of all the rings and uni-circumferential cylindricality. For many internally ribbed embodiments of this invention the circumferentially planar outer L-wall is preferably at a slightly obtuse L-angle with respect to the radially planar inner L-wall, and the circumferentially planar outer U-wall is at a slightly obtuse U-angle with respect to one said radially planar inner U-wall and a slightly acute U-angle with respect to the other radially planar inner U-wall; similarly, for some externally ribbed embodiments of this invention the circumferentially planar inner L-wall is preferably at a slightly obtuse L-angle with respect to the radially planar outer L-wall, and the circumferentially planar inner U-wall is at a slightly obtuse U-angle with respect to one radially planar outer U-wall and a slightly acute U-angle with respect to the other radially planar outer U-wall. For some of these embodiments, in furtherance of continuity or smoothness of the non-ribbed cylindrical surface, the circumferentially planar L-wall is tapered; i.e., the L-angle between the substantially straight outer interior L-surface and the substantially straight inner interior L-surface is slightly obtuse, while at the same time for such internally ribbed embodiments the outer exterior L-surface is tapered and for such externally ribbed embodiments the inner exterior L-surface is tapered.

Other internally ribbed embodiments of this invention preferably utilize a stepped L-ring configuration, having perpendicularity of the stepped circumferentially planar outer L-wall with respect to the radially planar inner L-wall and perpendicularity of the circumferentially planar outer U-wall with respect to the two radially planar inner U-walls; similarly, other externally ribbed embodiments of this invention preferably utilize a stepped L-ring configuration, having perpendicularity of the stepped circumferentially planar inner L-wall with respect to the radially planar outer L-wall and perpendicularity of the circumferentially planar inner U-wall with respect to the two radially planar outer U-walls.

A principal feature of the present invention is the construction of the cylinder from nestled prefabricated rings. For a low production item, such as a pressure hull, it could be less expensive to build the item from many smaller pieces, according to this invention, rather than one large piece; this is especially so if the smaller pieces are dimensionally uniform, as are the L-rings and U-rings for many embodiments of this invention. The ring fabrication equipment and alignment equipment would likely cost significantly less than what would be required for a monocoque hull. NDE of the rings would be simpler and more efficient both because of the thinner section and because of the logistics involved in moving, mounting and inspecting a small light item versus a large heavy item. Should the quality control process identify a sub-standard part, the part would be repaired more easily because it would have a thinner section thickness and because it would be physically smaller than a monocoque hull; perhaps more importantly, should the part not be repairable and have to be discarded, the loss would be a fraction of that of a monocoque hull, and would result in significantly reduced refabrication time.

In this regard, in accordance with the present invention, some embodiments further feature slightly non-perpendicular relationship of the circumferentially planar L-wall with the radially planar L-wall and of the circumferentially planar U-wall with the two radially planar U-walls; alternatively, some embodiments of this invention feature perpendicular relationship of a circumferentially planar L-wall which is stepped with the radially planar L-wall and of the circumferentially planar U-wall with the two radially planar U-walls. Some embodiments of this invention feature both, i.e., slightly non-perpendicular relationship of a stepped circumferentially planar L-wall with the radially planar L-wall and of the circumferentially planar U-wall with the two radially planar U-walls. The present invention additionally features, for some embodiments, tapering of the L-surfaces which comprise the non-ribbed cylindrical surface, in furtherance of smoothness or continuity thereof.

A most notable related feature of this invention is that the circumferential rib-stiffeners are formed as the rings are joined together during the cylinder construction; the rib-stiffeners, collectively considered, become an integral constituent of the cylinder. Since every part of the cylinder skin can be traced to a rib-stiffener, the dominant load path between the rib-stiffeners and the cylinder skin is through the reinforced cylinder elements, rather than through a bond line or a through thickness path. This construction also allows radial reinforcement of the stiffeners. In standard pressure hull operation the bonded joints will only be loaded in through thickness compression and shear.

One method to reduce the residual stresses attendant a cylinder is to reduce the cylinder's thickness-to-diameter ratio. The fabrication method in accordance with the present invention effectively does this. For many embodiments of this invention each individual section of the cylinder will be on the order of one-third as thick-walled as an equivalent monolithic composite cylinder, and will have correspondingly lower residual stresses.

Other objects, advantages and features of the present invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
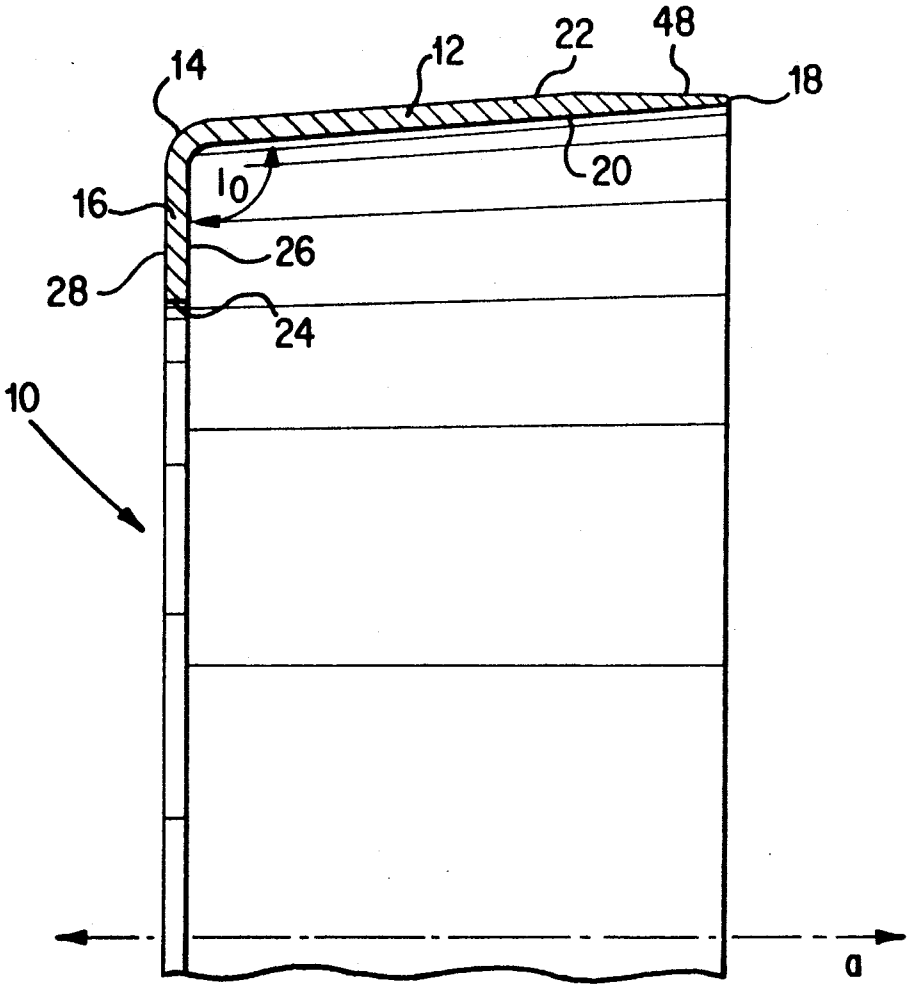
FIG. 1 is a diagrammatic partial sectional view of an L-ring according to this invention, taken along the plane of the axially longitudinal line a in FIG. 3.

Referring now to FIG. 1, an internally circumferentially rib-stiffened hollow cylinder in accordance with this invention is to be constructed from prefabricated rings of two types, vis., a plurality of radially inward L-rings 10 and a plurality of radially inward U-rings 30.

L-ring 10 has circumferentially planar outer L-wall 12, L-bend interface 14 and radially planar inner L-wall 16. L-ring 10 has an approximate "L" cross-section; i.e., L-ring 10 has circumferentially planar outer L-wall 12, L-bend interface 14 and radially planar inner L-wall 16 defining in outwardly radial cross-section an approximate inverted "L"-shape.

Circumferentially planar outer L-wall 12 has outer L-edge 18, outer interior L-surface 20 and outer exterior L-surface 22. Radially planar inner L-wall 16 has inner L-edge 24, inner interior L-surface 26 and inner exterior L-surface 28. Circumferentially planar outer L-wall 12 is at a slightly obtuse angle, obtuse L-angle $1_o$, with respect to radially planar inner L-wall 16. In this example circumferentially planar outer L-wall 12 is of substantially even thickness between outer interior L-surface 20 and outer exterior L-surface 22, except that outer exterior L-surface 22 has taper 48 narrowing toward outer L-edge 18.

Figure 2:
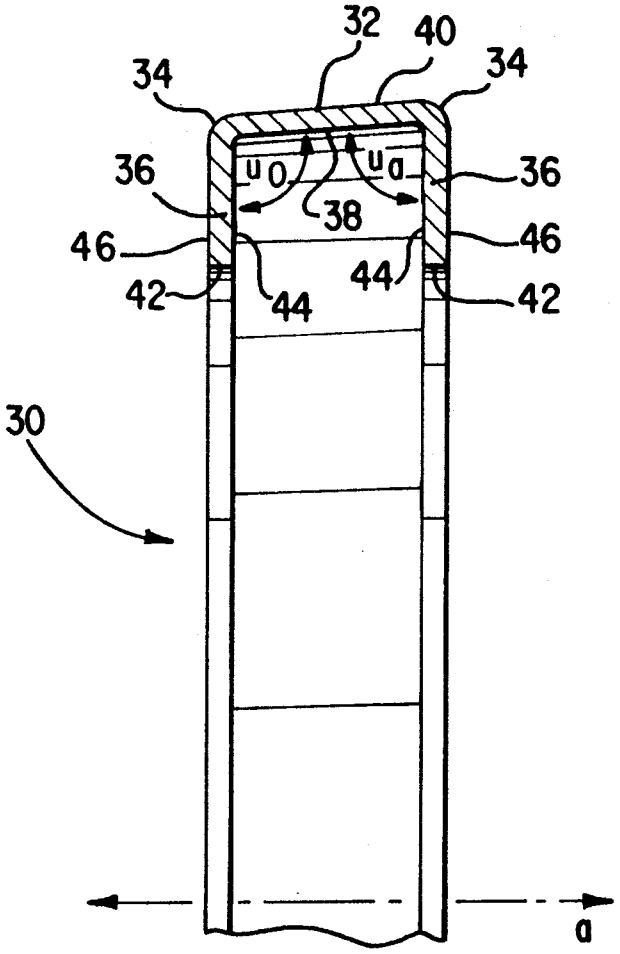
FIG. 2 is a view as in FIG. 1 of a U-ring according to this invention.

With reference to FIG. 2, U-ring 30 has circumferentially planar outer U-wall 32, a pair of U-bend interfaces 34 and a pair of radially planar inner U-walls 36. U-ring 30 has an approximate "U" cross-section; i.e., U-ring 30 has circumferentially planar outer U-wall 32, a pair of U-bend interfaces 34 and a pair of radially planar inner U-walls 36 defining in outwardly radial cross-section an approximate inverted "U"-shape.

Circumferentially planar outer U-wall 32 has outer interior U-surface 38 and outer exterior U-surface 40. Each radially planar inner U-wall 36 has inner U-edge 42, inner interior U-surface 44 and inner exterior U-surface 46. In this example circumferentially planar outer U-wall 32 is of substantially even thickness between outer interior U-surface 38 and outer exterior U-surface 40; each radially planar inner U-wall 36 is of substantially even thickness between inner interior U-surface 44 and inner exterior U-surface 46. Circumferentially planar outer U-wall 32 is at a slightly obtuse angle, obtuse U-angle $u_o$, with respect to one radially planar inner U-wall 36; circumferentially planar outer U-wall 32 is at a slightly acute angle, acute U-angle $u_a$, with respect to the other radially planar inner U-wall 36. Each U-ring has radially planar inner L-walls 36 which are parallel; hence, $U_o+u_a=180°$.

Figure 3:
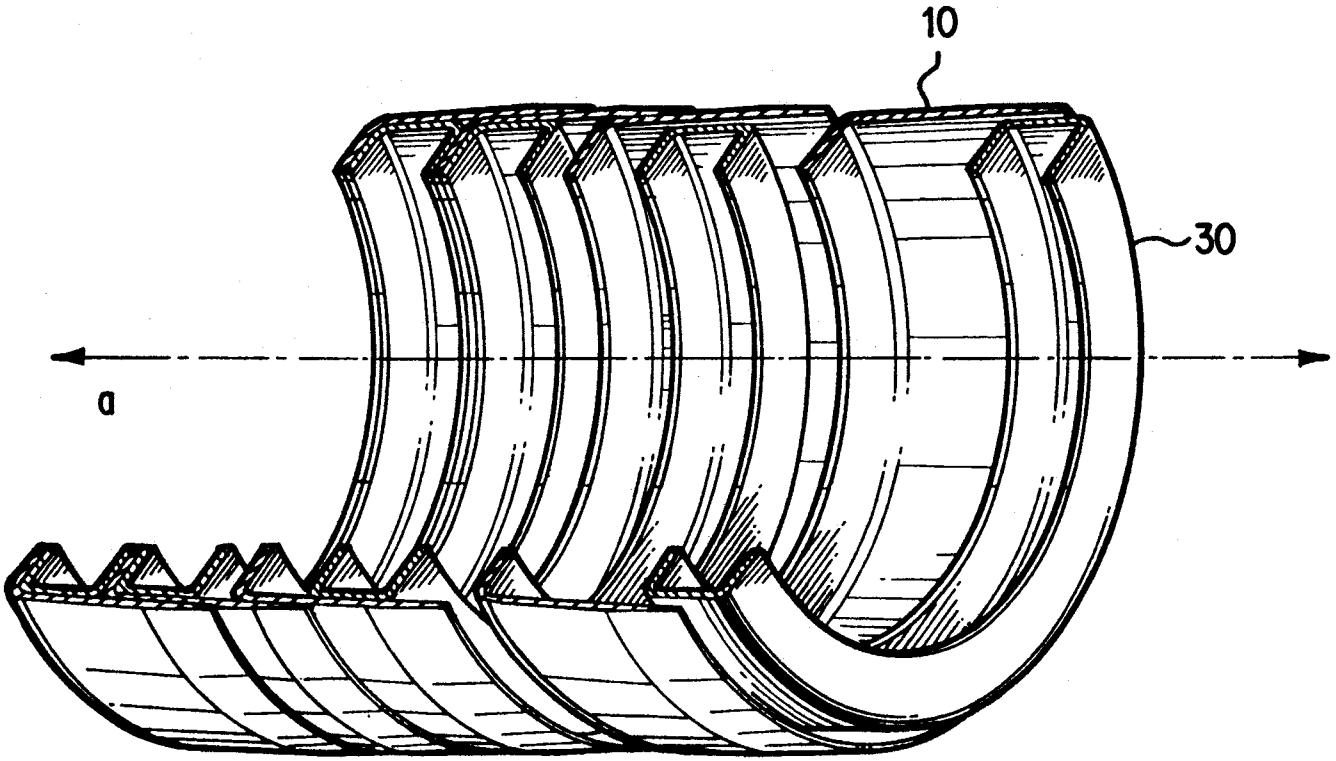
FIG. 3 is a diagrammatic partial perspective view of an internally rib-stiffened cylinder being fabricated in accordance with this invention.

Reference now being made to FIG. 3, L-rings 10 and U-rings 30 are appropriately sized and configured so as to admit of nestling relationship in accordance with this invention. If either or both of L rings 10 and U-rings 30 are composite they can be fabricated by any of a number of methods known in the art, such as, e.g., autoclave cured prepreg or resin transfer molded preforms. Other materials can be used for L-rings 10 and/or U-rings 30 with varying benefits. For example, appropriately shaped metallic extrusions can be bent and welded to appropriate shape in order to form either L-rings 10 or U-rings 30 or both.

L-rings 10 and U-rings 30 are joined in the appropriate order using adhesive at the mating surfaces, and bolts, if required. L-rings 10 are axially and sequentially mated, and U-rings 30 are axially and correspondingly integrated within L-rings 10, along axial direction a, in any appropriate order of sequential and integral mating in accordance with this invention. It is necessary to maintain alignment during construction of the cylinder; the sections of the cylinder may be self-aligning, in accordance with this invention, if L-rings 10 and U-rings 30 are dimensionally accurate and the cylinder is built vertically.

Figure 4:
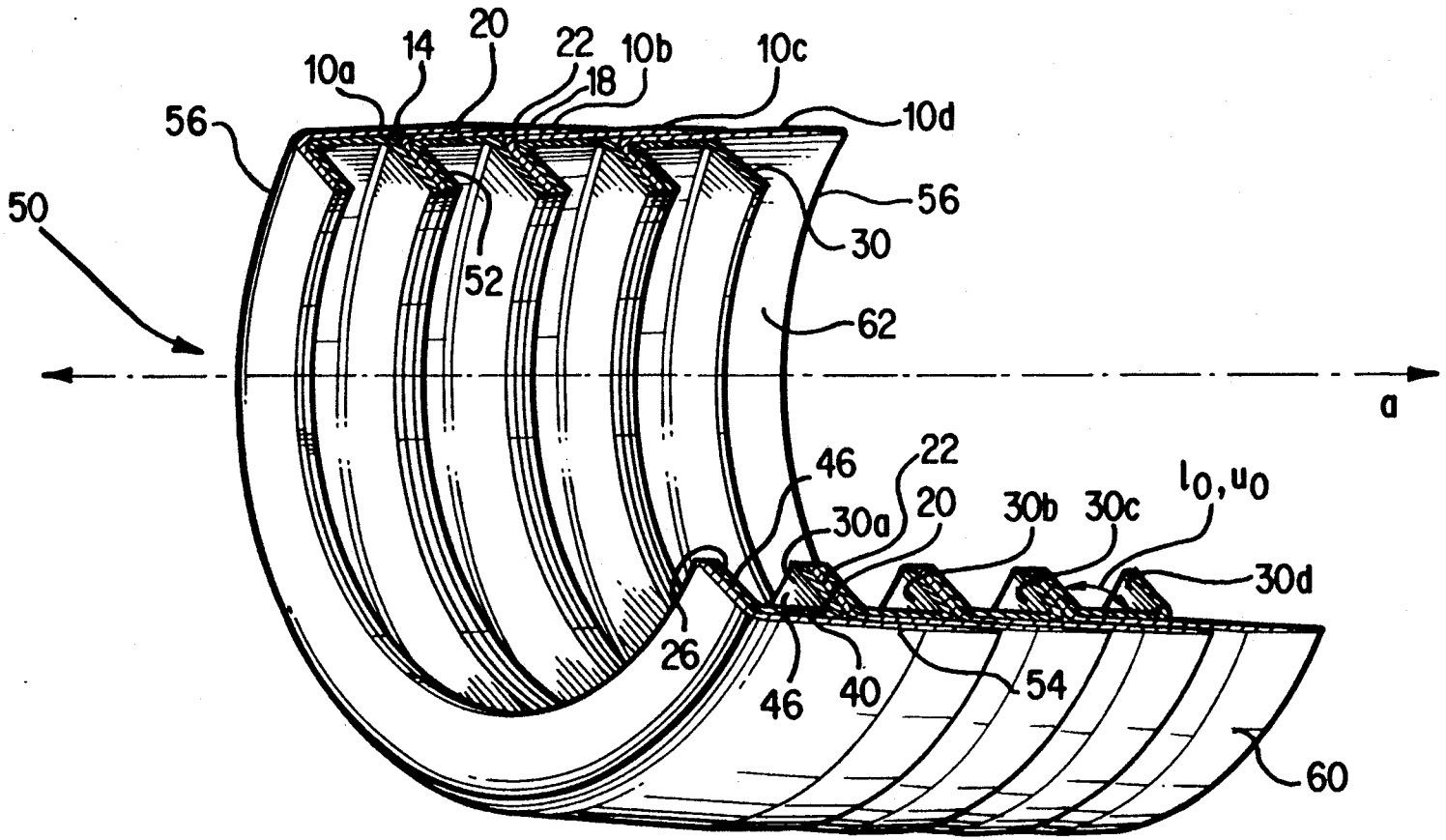
FIG. 4 is a view as in FIG. 3 of a completed internally rib-stiffened cylinder in accordance with this invention.

Referring to FIG. 4, a plurality of axially and sequentially mated L-rings 10, along with a plurality of U-rings axially and correspondingly integrated within L-rings 10, form completed internally rib-stiffened hollow cylinder 50 having non-ribbed cylinder wall surface 60, ribbed cylinder wall surface 62, and a plurality of internal circumferential ribs 52. L-ring $10_a$ is overlappingly aligned with the sequentially succeeding L-ring, L-ring $10_b$, so as to have flush a portion of outer interior L-surface 20 which is bounded by outer L-edge 18 with a portion of outer exterior L-surface 22 of sequentially succeeding L-ring $10_b$ which is bounded by L-bend interface 14. Similarly, L-ring $10_b$ is overlappingly aligned with the sequentially succeeding L-ring, L-ring $10_c$, so as to have flush a portion of outer interior L-surface 20 which is bounded by outer L-edge 18 with a portion of outer exterior L-surface 22 of sequentially succeeding L-ring $10_c$ which is bounded by L-bend interface 14. Likewise, L-ring $10_c$ is overlappingly aligned with the sequentially succeeding L-ring, L-ring $10_d$, so as to have flush a portion of outer interior L-surface 20 which is bounded by outer L-edge 18 with a portion of outer exterior L-surface 22 of sequentially succeeding L-ring $10_d$ which is bounded by L-bend interface 14. Sequentially last and axially endmost L-ring $10_d$ is not overlappingly aligned with a sequentially succeeding L-ring 10, as there is no sequentially succeeding L-ring 10.

U-ring $30_a$ is adjacently aligned with the sequentially succeeding U-ring, U-ring $30_b$, so as to have flush outer exterior U-surface 40 with a portion of outer interior L-surface 20 of L-ring $10_a$. One inner exterior U-surface 46 is flush with inner interior L-surface 26 of L-ring $10_a$; the other inner exterior U-surface 46 is flush with inner exterior L-surface 22 of sequentially succeeding L-ring $10_b$. Similarly, U-ring $30_b$ is adjacently aligned with sequentially succeeding U-ring $30_c$ so as to have flush outer exterior U-surface 40 with a portion of outer interior L-surface 20 of L-ring $10_b$; one inner exterior U-surface 46 is flush with inner interior L-surface 26 of L-ring $10_b$, and the other inner exterior U-surface 46 is flush with inner exterior L-surface 22 of sequentially succeeding L-ring $10_c$. Likewise, U-ring $30_c$ is adjacently aligned with sequentially succeeding U-ring $30_d$ so as to have flush outer exterior U-surface 40 with a portion of outer interior L-surface 20 of L-ring $10_c$; one inner exterior U-surface 46 is flush with inner interior L-surface 26 of L-ring $10_c$, and the other inner exterior U-surface 46 is flush with inner exterior L-surface 22 of sequentially succeeding L-ring $10_d$. Sequentially last and axially endmost U-ring $10_d$ has outer exterior U-surface 40 flush with a portion of outer interior L-surface 20 of L-ring $10_d$ and one inner exterior U-surface 46 flush with inner interior L-surface 26 of L-ring $10_d$; however, the other inner exterior U-surface 46 of U-ring $10_d$ is not flush with an inner exterior L-surface 22 of sequentially succeeding L-ring 10, as there is no sequentially succeeding L-ring 10. Each U-ring 30 has slightly obtuse U-angle $u_o$ which equals slightly obtuse L-angle $1_o$ for the L-ring 10 having flush a portion of outer interior L-surface 20 with outer exterior U-surface 40 of that U-ring 10.

Internal circumferential ribs 52 are formed as L-rings 10 and U-rings 30 are joined together. The three intermediate circumferential ribs 52, i.e., those separately including radially planar inner L-wall 16 for L-ring $10_b$, $10_c$ and $10_d$, are complete circumferential ribs 52; each intermediate circumferential rib 52 includes radially planar inner L-wall 16 interposed between one radially planar inner U-wall 36 for one U-ring 10 and another radially planar inner U-wall 36 for an adjacent U-ring 10. The thicknesses of circumferential ribs 52 are dependent upon the thicknesses of radially planar inner L-walls 16 and of radially planar inner U-walls 36. The thickness of completed cylinder wall 56 at a particular axially-longitudinally intermediate point is dependent upon the thicknesses at that point of two circumferentially planar outer L-walls 12 and of one circumferentially planar outer U-wall 32. At the axial-longitudinal extremities 56 of completed cylinder skin 54 its thickness depends on the thicknesses of one circumferentially planar outer L-wall 12 and of one circumferentially planar outer U-wall 32, or of just one circumferentially planar outer U-wall 32. Either or both of extremities 56 are preferably machined or otherwise removed or finished for many embodiments of this invention.

Figure 5:
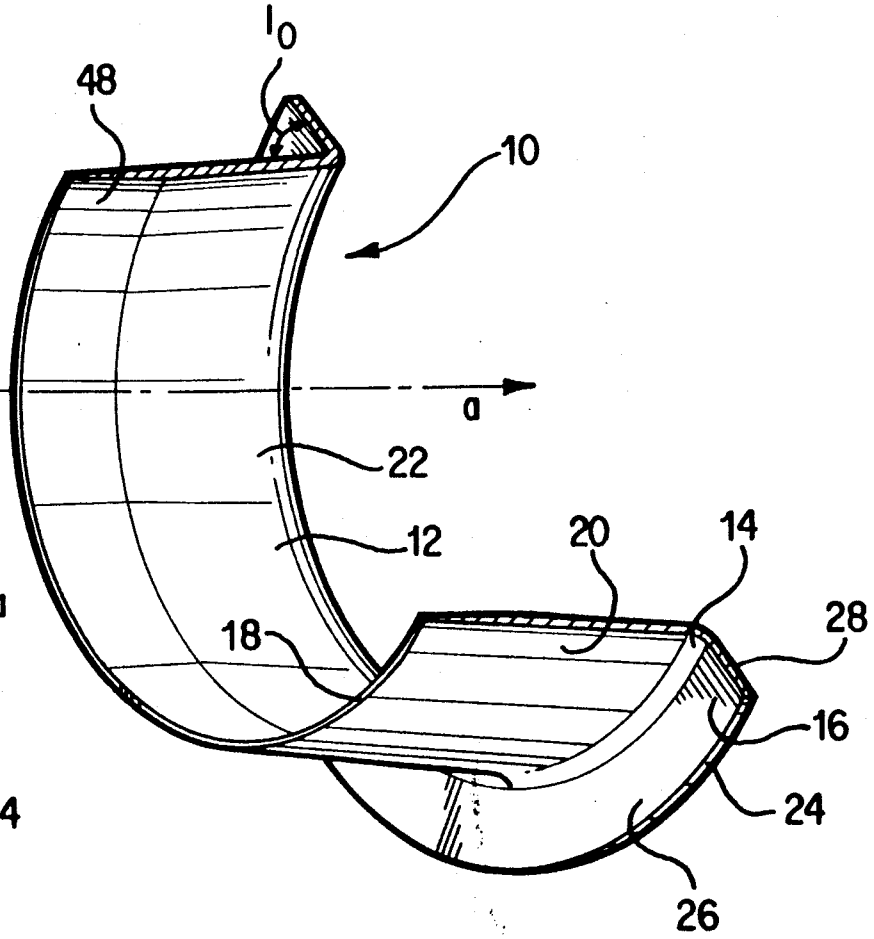
FIG. 5 is a diagrammatic partial perspective view of a L-ring for an externally rib-stiffened cylinder in accordance with this invention.
Figure 6:
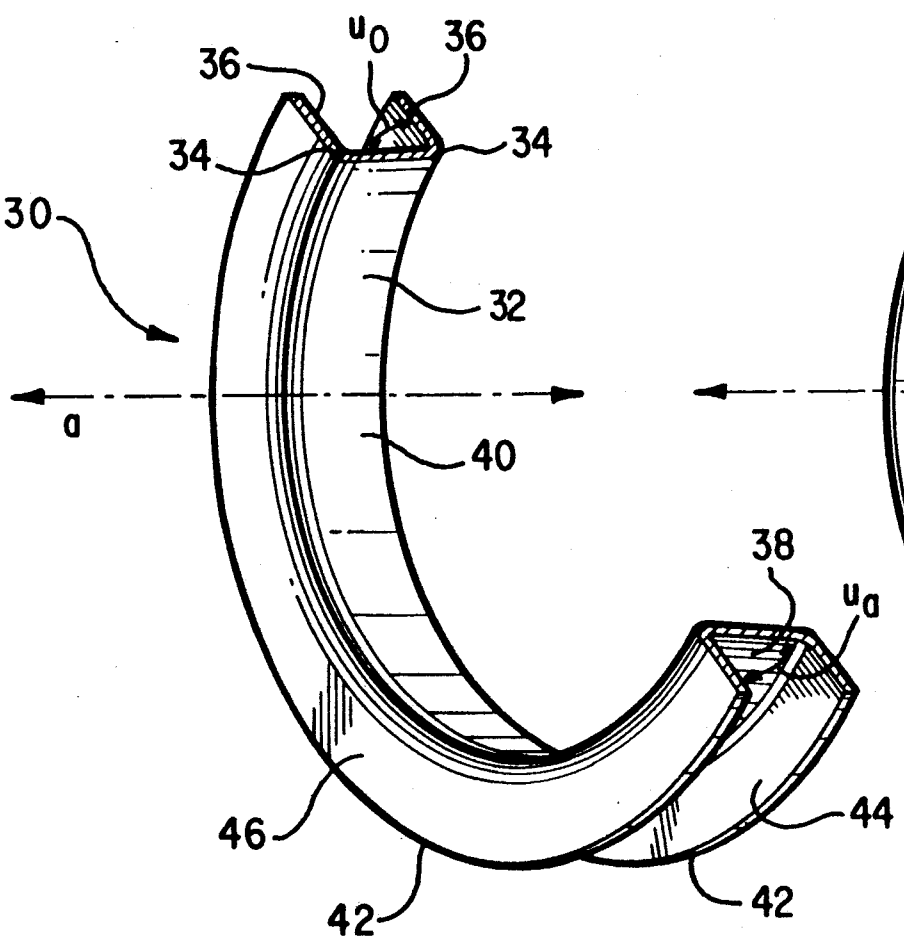
FIG. 6 is a view as in FIG. 5 of an U-ring for an externally rib-stiffened cylinder according to this invention.

Reference now being made to FIG. 5 and FIG. 6, an externally circumferentially rib-stiffened hollow cylinder in accordance with this invention is similarly to be constructed from prefabricated rings of two types, vis., a plurality of radially outward L-rings 10 and a plurality of radially outward U-rings 30.

With reference to FIG. 5, L-ring 10 has circumferentially planar inner L-wall 12, L-bend interface 14 and radially planar outer L-wall 16. Again, L-ring 10 has an approximate "L" cross-section; however, since L-ring 10 is radially outward, its radially outward cross-section is not an inverted "L"-shape but rather a regular (non-inverted) "L"-shape. Thus, L-ring 10 has circumferentially planar outer L-wall 12, L-bend interface 14 and radially planar inner L-wall 16 defining in outwardly radial cross-section an approximate "L"-shape. Circumferentially planar inner L-wall 12 has inner L-edge 18, inner interior L-surface 20 and inner exterior L-surface 22. Radially planar outer L-wall 16 has outer L-edge 24, outer interior L-surface 26 and outer exterior L-surface 28. Circumferentially planar inner L-wall 12 is at a slightly obtuse angle, obtuse L-angle $l_o$, with respect to radially planar outer L-wall 16. In this example circumferentially planar inner L-wall 12 is of substantially even thickness between inner interior L-surface 20 and inner exterior L-surface 22, except that inner exterior L-surface 22 has taper 48 narrowing toward inner L-edge 18.

With reference to FIG. 6, U-ring 30 has circumferentially planar inner U-wall 32, a pair of U-bend interfaces 34 and a pair of radially planar outer U-walls 36. U-ring 30 has a "U" cross-section; i.e., U-ring 30 has circumferentially planar inner U-wall 32, a pair of U-bend interfaces 34 and a pair of radially planar outer U-walls 36 defining in outwardly radial cross-section an approximate (non-inverted) "U"-shape. Circumferentially planar inner U-wall 32 has inner interior U-surface 38 and inner exterior U-surface 40. Each radially planar outer U-wall 36 has outer U-edge 42, outer interior U-surface 44 and outer exterior U-surface 46. In this example circumferentially planar inner U-wall 32 is of substantially even thickness between inner interior U-surface 38 and inner exterior U-surface 40; each radially planar outer U-wall 36 is of substantially even thickness between outer interior U-surface 44 and outer exterior U-surface 46. Circumferentially planar inner U-wall 32 is at a slightly obtuse angle, obtuse U-angle $u_o$, with respect to one radially planar outer U-wall 36; circumferentially planar inner U-wall 32 is at a slightly acute angle, acute U-angle $u_a$, with respect to the other radially planar outer U-wall 36. Each U-ring has radially planar outer L-walls 36 which are parallel; hence, $U_o + u_a = 180°$.

Figure 7:
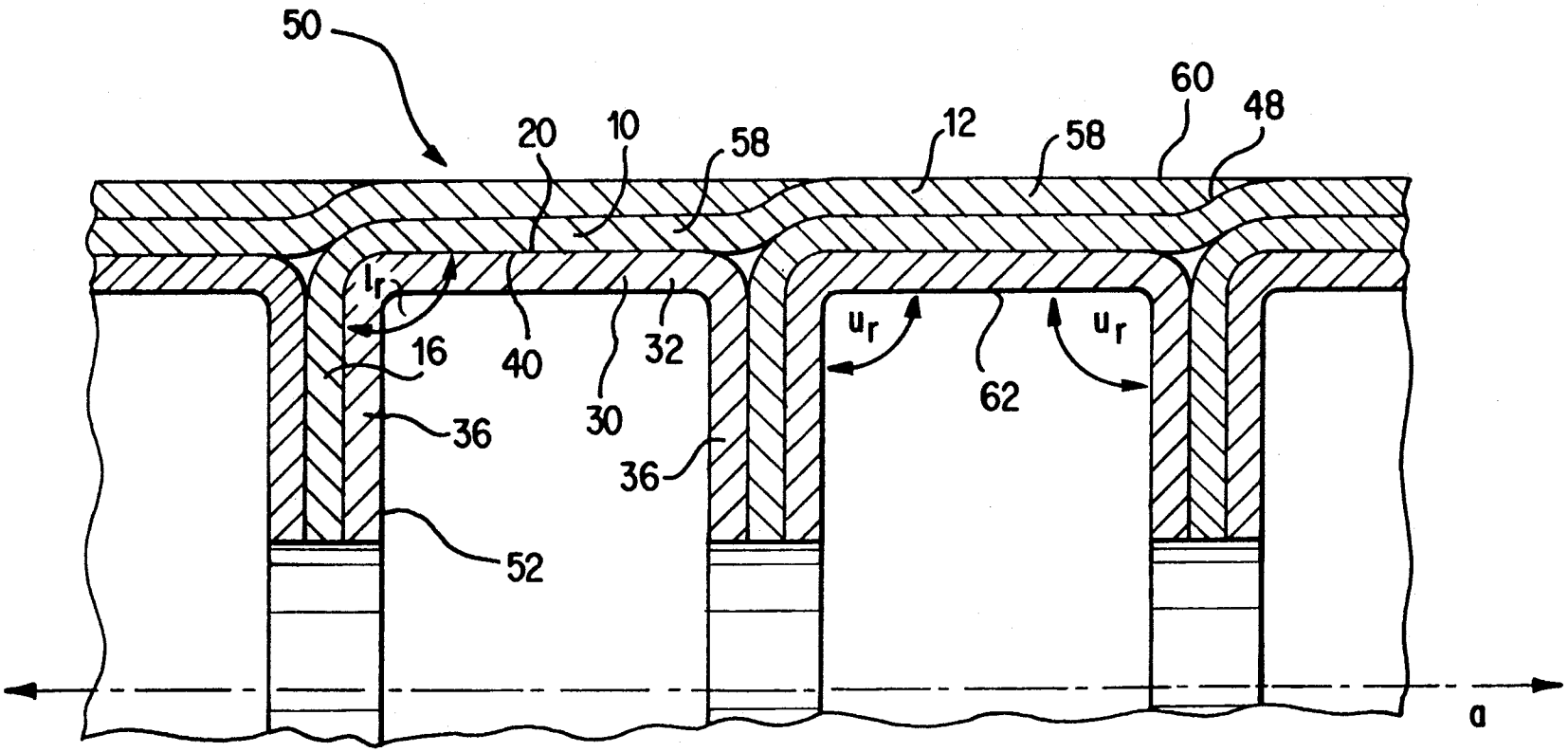
FIG. 7 is a view similar to FIG. 1 of a stepped L-ring-/U-ring configuration in accordance with this invention.

Now referring to FIG. 7, stepped radially inward (or radially outward) L-rings 10 and radially inward (or radially outward) U-rings 30 are appropriately sized and configured so as to admit of nestling relationship in accordance with this invention. FIG. 7 may be viewed as illustrating the nestling relationship according to this invention between and among either stepped radially inward L-rings 10 and radially inward U-rings 30, or stepped radially outward L-rings 10 and radially outward U-rings 30. A plurality of axially and sequentially mated stepped L-rings 10, along with a plurality of U-rings axially and correspondingly integrated within L-rings 10, form completed rib-stiffened hollow cylinder 50 having a plurality of circumferential ribs 52. Circumferentially planar L-wall 12 is stepped; each step 58 of circumferentially planar L-wall 12 is perpendicular with respect to radially planar L-wall 16, as indicated by right L-angle $l_r$. In this example circumferentially planar L-wall 12 has taper 48 in furtherance of continuity or smoothness of non-ribbed cylinder wall surface 60. Circumferentially planar L-wall 12 has any number of steps 58 for various embodiments in accordance with this invention. Circumferentially planar U-wall 32 is perpendicular with respect to each radially planar U-wall 36, as indicated by two right U-ring angles $u_r$. Each U-ring 30 has flush its circumferentially planar exterior U-surface 40 with a different portion of circumferentially planar interior L-surface 20, each portion of circumferentially planar interior L-surface 20 pertaining to a different step 58 of circumferentially planar L-wall 12.

Figure 8:
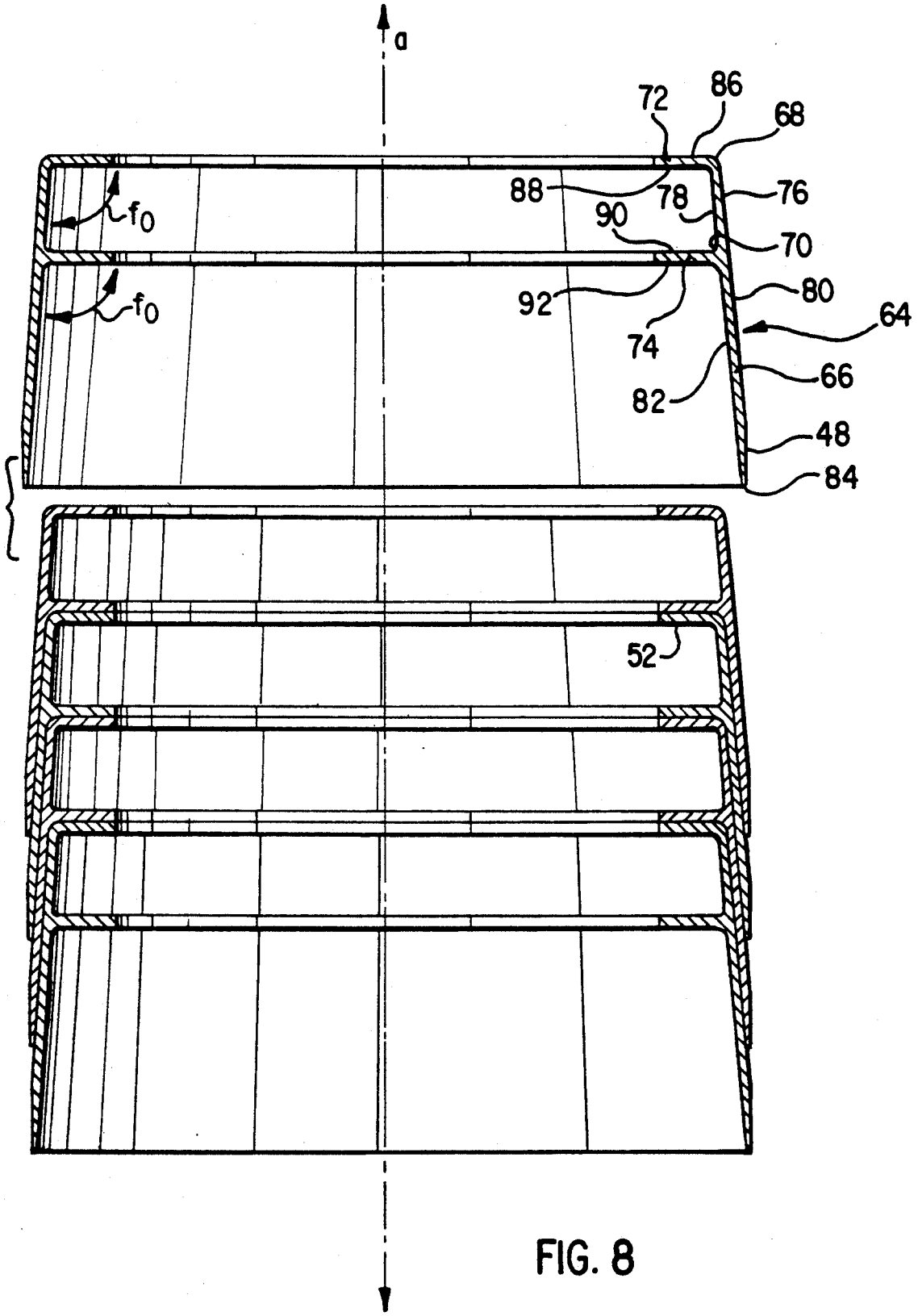
FIG. 8 is a view similar to FIG. 1 of an F-ring configuration in accordance with this invention.

Alternative embodiments of the present invention utilize F-rings only, instead of utilizing L-rings in conjunction with U-rings as in above-described embodiments of the present invention. These "F" section rings are, in effect, "L" section rings and "U" section rings joined together, and may provide cost benefits for some applications. In accordance with this invention, all geometrical variations which apply to L-rings 10 and U-rings 30 are applicable to F-rings 64. For example, with reference to FIG. 8, an internally or externally circumferentially rib-stiffened hollow cylinder having circumferential ribs 52 in accordance with this invention is to be constructed from prefabricated rings of a single type, vis., a plurality of F-rings 64, which are radially inward for internally ribbed embodiments and radially outward for externally ribbed embodiments. F-ring 64 has circumferentially planar F-wall 66, an upper F-bend interface 68, a lower F-bend interface 70, an upper radially planar F-wall 72, and a lower radially planar F-wall 74. F-ring 64 has an approximate "F" cross-section; i.e., F-ring 64 has circumferentially planar F-wall 66, F-bend interfaces 68 and 70, and radially planar F-walls 70 and 72 defining in axial cross-section an approximate "F"-shape for internally ribbed embodiments and an approximate backwards "F"-shape for externally ribbed embodiments. Circumferentially planar F-wall 66 is at a slightly obtuse angle, obtuse f-angle $f_o$, with respect to radially planar F-walls 72 and 74. Circumferentially planar F-wall 66 has exterior upper circumferentially planar F-wall surface 76 and interior upper circumferentially planar F-wall surface 78 between upper F-bend interface 68 and lower F-bend interface 70, and exterior lower circumferentially planar F-wall surface 80 and interior lower circumferentially planar F-wall surface 82 between lower F-bend interface 70 and circumferentially planar F-wall bottom edge 84. In this example exterior upper circumferentially planar F-wall surface 76 has taper 48. Upper radially planar F-wall 72 has exterior upper radially planar F-wall surface 86 and interior upper radially planar F-wall surface 88. Lower radially planar F-wall 74 has exterior lower radially planar F-wall surface 90 and interior lower radially planar F-wall surface 92. The F-rings are axially and sequentially mated. Each F-ring 64 other than the sequentially last F-ring 64 is overlappingly aligned with a sequentially succeeding F-ring 64 so as to have flush interior lower circumferentially planar F-wall surface 82 with exterior upper circumferentially planar F-wall surface 76 of the sequentially succeeding F-ring 64, and so as to have flush interior lower radially planar F-wall surface 92 with exterior upper radially planar F-wall surface 86 of the sequentially succeeding F-ring 64. Sequentially last F-ring 64 has flush exterior upper radially planar F-wall surface 86 with interior lower radially planar F-wall surface 92 of the sequentially preceding F-ring 64.

In some embodiments of this invention circumferentially planar F-wall 66 is stepped so that exterior upper circumferentially planar F-wall surface 76 is in stepped relationship with exterior lower circumferentially planar F-wall surface 80 and interior upper circumferentially planar F-wall surface 78 is in stepped relationship with interior lower circumferentially planar F-wall surface 82.

Figure 9:
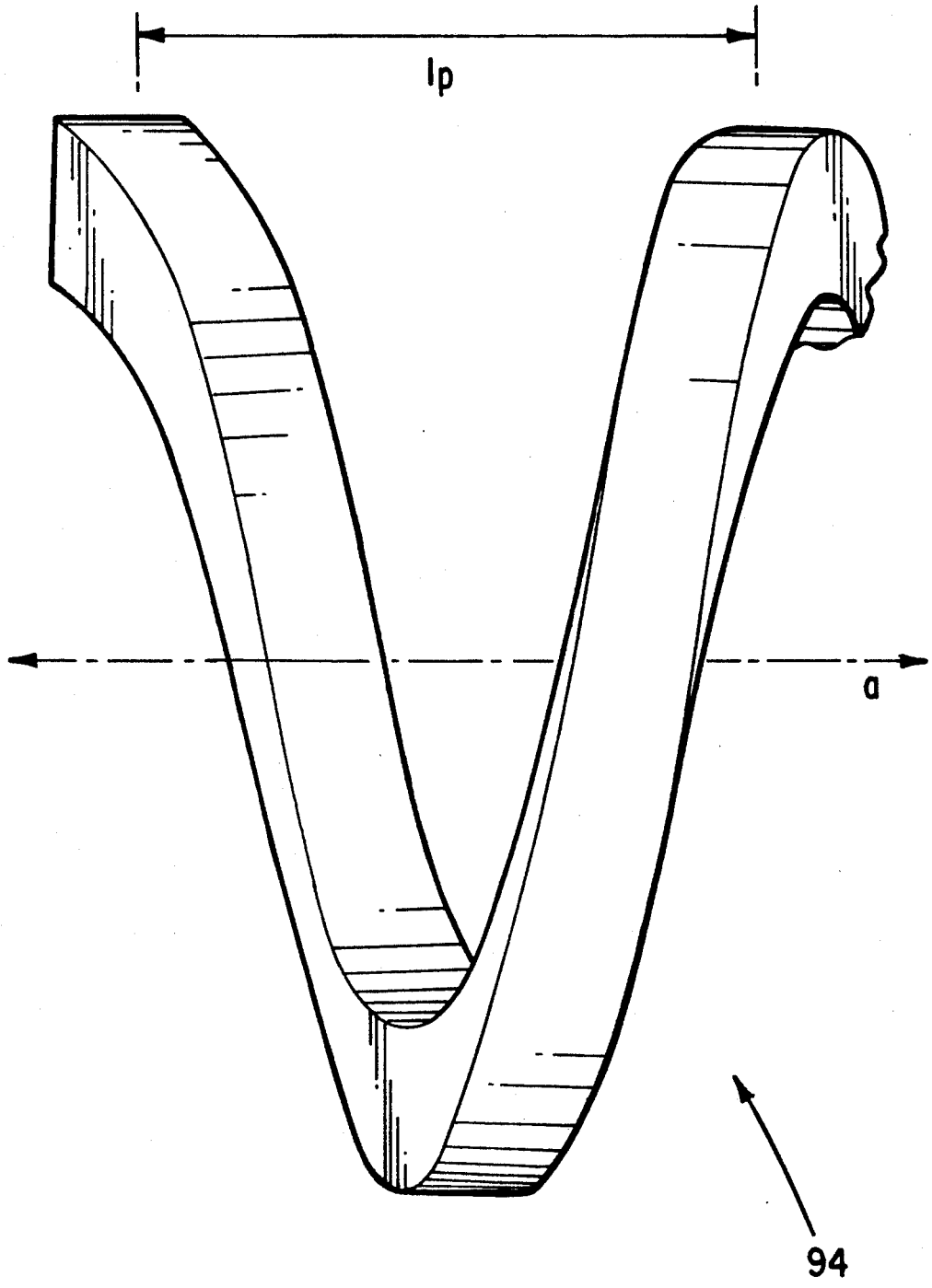
FIG. 9 is a view similar to FIG. 5 of a U-spiral in accordance with this invention.

Some embodiments of the present invention utilize "L," "U," and/or "F" section spirals, rather than rings, in accordance with the present invention. Pultrusion, a potentially cost-effective method of fabricating beams of constant cross-section, can be utilized to make these "L," "U," and "F" section spirals. Referring to FIG. 9, pitch length $l_p$ (exaggerated for illustration purposes) for U-spiral 94 is some multiple of the bay length, i.e., the distance between circumferential rib 50 and adjacent circumferential rib 50 for completed internally or externally rib-stiffened hollow cylinder 48.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A method for fabricating an internally circumferentially rib-stiffened hollow cylinder, comprising:

axially and sequentially mating a plurality of L-rings;

each said L-ring having a circumferentially planar outer L-wall, an L-bend interface and a radially planar inner L-wall defining in outwardly radial cross-section an approximate inverted "L"-shape;

said circumferentially planar outer L-wall having an outer L-edge, an outer interior L-surface and an outer exterior L-surface;

said radially planar inner L-wall having an inner L-edge, an inner interior L-surface and an inner exterior L-surface;

whereby each said L-ring other than the sequentially last said L-ring is overlappingly aligned with a sequentially succeeding said L-ring so as to have flush a portion of said outer interior L-surface which is bounded by said outer L-edge with a portion of said outer exterior L-surface of said sequentially succeeding said L-ring which is bounded by said L-bend interface; and axially and correspondingly integrating within said L-rings a plurality of U-rings;

each said U-ring having a circumferentially planar outer U-wall, a pair of U-bend interfaces and a pair of radially planar inner U-walls defining in outwardly radial cross-section an approximate inverted "U"-shape;

said circumferentially planar outer U-wall having an outer interior U-surface and an outer exterior U-surface;

each said radially planar inner wall having an inner U-edge, an inner interior U-surface and an inner exterior U-surface;

whereby each said U-ring other than the sequentially last said U-ring is adjacently aligned with a sequentially succeeding said U-ring so as to have flush said outer exterior U-surface with a portion of one said outer interior L-surface, one said inner exterior U-surface with said inner interior L-surface of same said L-ring, and the other said inner exterior U-surface with said inner exterior L-surface of said sequentially succeeding L-ring;

said sequentially last said U-ring having flush said outer exterior U-surface with a portion of one said outer interior L-surface and one said inner exterior U-surface with one said inner interior L-surface of same said L-ring.

2. A method for fabricating an externally circumferentially rib-stiffened hollow cylinder, comprising:

axially and sequentially mating a plurality of L-rings;

each said L-ring having a circumferentially planar inner L-wall, an L-bend interface and a radially planar outer L-wall defining in outwardly radial cross-section an approximate "L"-shape;

said circumferentially planar inner L-wall having an inner L-edge, an inner interior L-surface and an inner exterior L-surface;

said radially planar outer L-wall having an outer L-edge, an outer interior L-surface and an outer exterior L-surface;

whereby each said L-ring other than the sequentially last said L-ring is overlappingly aligned with a sequentially succeeding said L-ring so as to have flush a portion of said inner interior L-surface which is bounded by said inner L-edge with a portion of said inner exterior L-surface of said sequentially succeeding said L-ring which is bounded by said L-bend interface; and axially and correspondingly integrating without said L-rings a plurality of U-rings;

each said U-ring having a circumferentially planar inner U-wall, a pair of U-bend interfaces and a pair of radially planar outer U-walls defining in outwardly radial cross-section an approximate "U"-shape;

said circumferentially planar inner U-wall having an inner interior U-surface and an inner exterior U-surface;

each said radially planar outer wall having an outer U-edge, an outer interior U-surface and an outer exterior U-surface;

whereby each said U-ring other than the sequentially last said U-ring is adjacently aligned with a sequentially succeeding said U-ring so as to have flush said inner exterior U-surface with a portion of one said outer interior L-surface, one said outer exterior U-surface with said outer interior L-surface of same said L-ring, and the other said outer exterior U-surface with said outer exterior L-surface of said sequentially succeeding L-ring;

said sequentially last said U-ring having flush said inner exterior U-surface with a portion of one said inner interior L-surface and one said outer exterior U-surface with one said outer interior L-surface of same said L-ring.

3. An internally circumferentially rib-stiffened hollow cylinder, comprising:

a plurality of axially and sequentially mated L-rings; and a plurality of U-rings axially and correspondingly integrated within said L-rings;

each said L-ring having a circumferentially planar outer L-wall, an L-bend interface and a radially planar inner L-wall defining in outwardly radial cross-section an approximate inverted "L"-shape;

said circumferentially planar outer L-wall having an outer L-edge, an outer interior L-surface and an outer exterior L-surface;

said radially planar inner L-wall having an inner L-edge, an inner interior L-surface and an inner exterior L-surface;

whereby each said L-ring other than the sequentially last said L-ring is overlappingly aligned with a sequentially succeeding said L-ring so as to have flush a portion of said outer interior L-surface which is bounded by said outer L-edge with a portion of said outer exterior L-surface of said sequentially succeeding said L-ring which is bounded by said L-bend interface;

each said U-ring having a circumferentially planar outer U-wall, a pair of U-bend interfaces and a pair of radially planar inner U-walls defining in outwardly radial cross-section an approximate inverted "U"-shape;

said circumferentially planar outer U-wall having an outer interior U-surface and an outer exterior U-surface;

each said radially planar inner wall having an inner U-edge, an inner interior U-surface and an inner exterior U-surface;

whereby each said U-ring other than the sequentially last said U-ring is adjacently aligned with a sequentially succeeding said U-ring so as to have flush said outer exterior U-surface with a portion of one said outer interior L-surface, one said inner exterior U-surface with said inner interior L-surface of same said L-ring, and the other said inner exterior U-surface with said inner exterior L-surface of said sequentially succeeding L-ring;

said sequentially last said U-ring having flush said outer exterior U-surface with a portion of one said outer interior L-surface and one said inner exterior U-surface with one said inner interior L-surface of same said L-ring.

4. An externally circumferentially rib-stiffened hollow cylinder, comprising:

a plurality of axially and sequentially mated L-rings; and a plurality of U-rings axially and correspondingly integrated without said L-rings;

each said L-ring having a circumferentially planar inner L-wall, an L-bend interface and a radially planar outer L-wall defining in outwardly radial cross-section an approximate "L"-shape;

said circumferentially planar inner L-wall having an inner L-edge, an inner interior L-surface and an inner exterior L-surface;

said radially planar outer L-wall having an outer L-edge, and outer interior L-surface and an outer exterior L-surface;

whereby each said L-ring other than the sequentially last said L-ring is overlappingly aligned with a sequentially succeeding said L-ring so as to have flush a portion of said inner interior L-surface which is bounded by said inner L-edge with a portion of said inner exterior L-surface of said sequentially succeeding said L-ring which is bounded by said L-bend interface;

each said U-ring having a circumferentially planar inner U-wall, a pair of U-bend interfaces and a pair of radially planar outer U-walls defining in outwardly radial cross-section an approximate "U"-shape;

said circumferentially planar inner U-wall having an inner interior U-surface and an inner exterior U-surface;

each said radially planar outer wall having an outer U-edge, an outer interior U-surface and an outer exterior U-surface;

whereby each said U-ring other than the sequentially last said U-ring is adjacently aligned with a sequentially succeeding said U-ring so as to have flush said inner exterior U-surface with a portion of one said outer interior L-surface, one said outer exterior U-surface with said outer interior L-surface of same said L-ring, and the other said outer exterior U-surface with said outer exterior L-surface of said sequentially succeeding L-ring;

said sequentially last said U-ring having flush said inner exterior U-surface with a portion of one said inner interior L-surface and one said outer exterior U-surface with one said outer interior L-surface of same said L-ring.

5. A method for fabricating an internally rib-stiffened hollow cylinder as in claim 1, wherein said circumferentially planar outer L-wall is at a slightly obtuse L-angle with respect to said radially planar inner L-wall, and said circumferentially planar outer U-wall is at a slightly obtuse U-angle with respect to one said radially planar inner U-wall and at a slightly acute U-angle with respect to the other said radially planar inner U-wall.

6. A method for fabricating an externally rib-stiffened hollow cylinder as in claim 2, wherein said circumferentially planar outer L-wall is at a slightly obtuse L-angle with respect to said radially planar inner L-wall, and said circumferentially planar outer U-wall is at a slightly obtuse U-angle with respect to one said radially planar inner U-wall and at a slightly acute U-angle with respect to the other said radially planar inner U-wall.

7. A method for fabricating an internally rib-stiffened hollow cylinder as in claim 5, wherein each said U-ring has said slightly obtuse U-angle which equals said slightly obtuse L-angle for said L-ring having flush a said portion of said outer interior L-surface with said outer exterior U-surface of said U-ring.

8. A method for fabricating an externally rib-stiffened hollow cylinder as in claim 6, wherein each said U-ring has said slightly obtuse U-angle which equals said slightly obtuse L-angle for said L-ring having flush a said portion of said inner interior L-surface with said inner exterior U-surface of said U-ring.

9. A method for fabricating an internally rib-stiffened hollow cylinder as in claim 1, wherein said circumferentially planar outer L-wall is stepped and perpendicular with respect to said radially planar inner L-wall, said circumferentially planar outer U-wall is perpendicular with respect to each said radially planar inner U-wall, and each said U-ring has flush said outer exterior U-surface with a said portion of said outer interior L-surface for a different said step of said circumferentially planar outer L-wall.

10. A method for fabricating an externally rib-stiffened hollow cylinder as in claim 2, wherein said circumferentially planar inner L-wall is stepped and perpendicular with respect to said radially planar outer L-wall, said circumferentially planar inner U-wall is perpendicular with respect to each said radially planar outer U-wall, and each said U-ring has flush said inner exterior U-surface with a said portion of said inner interior L-surface for a different said step of said circumferentially planar inner L-wall.

11. An internally rib-stiffened hollow cylinder as in claim 3, wherein said circumferentially planar outer L-wall is stepped and perpendicular with respect to said radially planar inner L-wall, said circumferentially planar outer U-wall is perpendicular with respect to each said radially planar inner U-wall, and each said U-ring has flush said outer exterior U-surface with a said portion of said outer interior L-surface for a different said step of said circumferentially planar outer L-wall.

12. An externally rib-stiffened hollow cylinder as in claim 4, wherein said circumferentially planar inner L-wall is stepped and perpendicular with respect to said radially planar outer L-wall, said circumferentially planar inner U-wall is perpendicular with respect to each said radially planar outer U-wall, and each said U-ring has flush said inner exterior U-surface with a said portion of said inner interior L-surface for a different said step of said circumferentially planar inner L-wall.

13. A method for fabricating an internally rib-stiffened hollow cylinder as in claim 1, wherein at least one said rib includes one said radially planar inner L-wall interposed between one said radially planar inner U-wall for one said U-ring and another said radially planar inner U-wall for an adjacent said U-ring.

14. A method for fabricating an externally rib-stiffened hollow cylinder as in claim 2, wherein at least one said rib includes one said radially planar outer L-wall interposed between one said radially planar outer U-wall for one said U-ring and another said radially planar outer U-wall for an adjacent said U-ring.

15. An internally rib-stiffened hollow cylinder as in claim 3, wherein at least one said rib includes one said radially planar inner L-wall interposed between one said radially planar inner U-wall for one said U-ring and another said radially planar inner U-wall for an adjacent said U-ring.

16. An externally rib-stiffened hollow cylinder as in claim 4, wherein at least one said rib includes one said radially planar outer L-wall interposed between one said radially planar outer U-wall for one said U-ring and another said radially planar outer U-wall for an adjacent said U-ring.

17. A method for fabricating an internally rib-stiffened hollow cylinder as in claim 1, wherein said L-rings and U-rings are uniform.

18. A method for fabricating an externally rib-stiffened hollow cylinder as in claim 2, wherein said L-rings and U-rings are uniform.

19. An internally rib-stiffened hollow cylinder as in claim 3, wherein said L-rings and U-rings are uniform.

20. An externally rib-stiffened hollow cylinder as in claim 4, wherein said L-rings and U-rings are uniform.

21. A method for fabricating an internally rib-stiffened hollow cylinder as in claim 1, wherein at least one said L-ring has a tapered said circumferentially planar outer L-wall.

22. A method for fabricating an externally rib-stiffened hollow cylinder as in claim 2, wherein at least one said L-ring has a tapered said circumferentially planar inner L-wall.

23. An internally rib-stiffened hollow cylinder as in claim 3, wherein at least one said L-ring has a tapered said circumferentially planar outer L-wall.

24. An externally rib-stiffened hollow cylinder as in claim 4, wherein at least one said L-ring has a tapered said circumferentially planar inner L-wall.

25. A method for fabricating a circumferentially rib-stiffened hollow cylinder, comprising:

axially and sequentially mating a plurality of F-rings;

each said F-ring having a circumferentially planar F-wall, an upper F-bend interface, a lower F-bend interface, an upper radially planar F-wall, and a lower radially planar F-wall;

said circumferentially planar F-wall having an exterior upper circumferentially planar F-wall surface and an interior upper circumferentially planar F-wall surface between said upper F-bend interface and said lower F-bend interface, and an exterior lower circumferentially planar F-wall surface and an interior lower circumferentially planar F-wall surface between said lower F-bend interface and a circumferentially planar F-wall bottom edge;

said upper radially planar F-wall having an exterior upper radially planar F-wall surface and an interior upper radially planar F-wall surface;

said lower radially planar F-wall having an exterior lower radially planar F-wall surface and an interior lower radially planar F-wall surface;

whereby each said F-ring other than the sequentially last said F-ring 64 is overlappingly aligned with a sequentially succeeding said F-ring so as to have flush said interior lower circumferentially planar F-wall surface with said exterior upper circumferentially planar F-wall surface of said sequentially succeeding said F-ring, and so as to have flush said interior lower radially planar F-wall surface with said exterior upper radially planar F-wall surface of said sequentially succeeding said F-ring;

said sequentially last said F-ring having flush said exterior upper radially planar F-wall surface with said interior lower radially planar F-wall surface of said sequentially preceding said F-ring.

26. A circumferentially rib-stiffened hollow cylinder, comprising:

a plurality of axially and sequentially mated F-rings;

each said F-ring having a circumferentially planar F-wall, an upper F-bend interface, a lower F-bend interface, an upper radially planar F-wall, and a lower radially planar F-wall;

said circumferentially planar F-wall having an exterior upper circumferentially planar F-wall surface and an interior upper circumferentially planar F-wall surface between said upper F-bend interface and said lower F-bend interface, and an exterior lower circumferentially planar F-wall surface and an interior lower circumferentially planar F-wall surface between said lower F-bend interface and a circumferentially planar F-wall bottom edge;

said upper radially planar F-wall having an exterior upper radially planar F-wall surface and an interior upper radially planar F-wall surface;

said lower radially planar F-wall having an exterior lower radially planar F-wall surface and an interior lower radially planar F-wall surface;

whereby each said F-ring other than the sequentially last said F-ring 64 is overlappingly aligned with a sequentially succeeding said F-ring so as to have flush said interior lower circumferentially planar F-wall surface with said exterior upper circumferentially planar F-wall surface of said sequentially succeeding said F-ring, and so as to have flush said interior lower radially planar F-wall surface with said exterior upper radially planar F-wall surface of said sequentially succeeding said F-ring;

said sequentially last said F-ring having flush said exterior upper radially planar F-wall surface with said interior lower radially planar F-wall surface of said sequentially preceding said F-ring.

* * * * *